United States Patent [19]

Schröter et al.

[11] 4,109,268

[45] Aug. 22, 1978

[54] APPARATUS FOR DEVELOPING A PHOTOSENSITIVE MATERIAL USING A VAPOROUS AMMONIA-CONTAINING DEVELOPER

[75] Inventors: Herbert Schröter, Taunusstein; Eckehard Stein, Frankfurt, both of Fed. Rep. of Germany

[73] Assignee: Hoechst Aktiengesellschaft, Fed. Rep. of Germany

[21] Appl. No.: 787,273

[22] Filed: Apr. 13, 1977

[30] Foreign Application Priority Data

Apr. 15, 1976 [DE] Fed. Rep. of Germany ..... 2616812

[51] Int. Cl.[2] ..... G03D 7/00

[52] U.S. Cl. ..... 354/299; 354/300

[58] Field of Search ..... 354/299, 300, 319, 297; 34/115, 155, 216

[56] References Cited

U.S. PATENT DOCUMENTS

| | | | |
|---|---|---|---|
| 1,037,873 | 9/1912 | Crabb | 118/424 |
| 2,058,983 | 10/1936 | Horn | 354/300 |
| 2,431,041 | 11/1947 | Hassler | 354/300 |
| 3,720,150 | 3/1973 | Hurtig et al. | 354/300 |
| 4,019,193 | 4/1977 | Holman | 354/300 |
| 4,056,824 | 11/1977 | Iiyama et al. | 354/300 |

FOREIGN PATENT DOCUMENTS

| | | | |
|---|---|---|---|
| 1,905,203 | 12/1971 | Fed. Rep. of Germany | 354/297 |
| 1,414,410 | 11/1975 | United Kingdom | 354/300 |

*Primary Examiner*—L. T. Hix
*Assistant Examiner*—Alan Mathews
*Attorney, Agent, or Firm*—James E. Bryan

[57] ABSTRACT

In a diazo copier, a first developing chamber for developing a diazo material employing an ammonia-containing vaporous developer, a second chamber adjacent an output aperture of the first developing chamber, a source of heat, and a suction device for drawing off developer escaping from the second developing chamber through an output aperture and for removing developer from the diazo material are provided. A rotatably mounted porous hollow roller means forms part of said suction device positioned in said second chamber and a suction duct means is connected to said roller means. A transport means which is not in heat-conducting connection with the source of heat is provided for bringing the copying material in contact with the hollow suction roller means.

14 Claims, 3 Drawing Figures

1
2
3
4
5
6
7
8
9
10
11
12
13
14
15
16
17a
17b
17c
21
22
23
24
25
26
27
28
44
45
46
47
48
49

APPARATUS FOR DEVELOPING A PHOTOSENSITIVE MATERIAL USING A VAPOROUS AMMONIA-CONTAINING DEVELOPER

The present invention relates to apparatus for developing a photosensitive material using a vaporous ammonia-containing developer.

It is the object of the present invention to prevent a gaseous or vaporous developer, especially a developer containing ammonia, from pervading the surrounding working area, when it is carried out of the developing chamber together with the developed copying material. The problem becomes serious in those cases where the developer contains ammonia which may pollute the environment, as the ammonia transported out of the developing chamber together with the copying material is gradually diffused into the ambient air and may at least cause unpleasant odors.

In connection with developing microfilms it is known to pass such films through a heated developer/air mixture in an after-chamber placed behind a developing chamber, in order to remove condensation products adhering to the surface of the microfilm material. This process is a step within a cycle followed by the developer/air mixture. The developer and microfilm material move in countercurrent relationship, i.e. following the aforementioned step in the flow direction of the developer, the microfilm material, which is transported through the developing chamber before entering the after-chamber, is also in the developing chamber treated with the developer/air mixture. In the developing chamber, however, the temperaature of the developer-/air mixture is close to the dew point, so that a developer condensate precipitates onto the surface of the microfilm. The developer/air mixture depleted as a result of this precipitation is drawn out of the developing chamber, enriched with water vapor and then heated, before re-entering the after-chamber (U.S. Pat. No. 3,720,150).

The condensation products forming drops on the surface of the film-base microfilm material must be removed in this developing procedure in order to obtain good copies. However, the process employed for this purpose and the apparatus for carrying out the process are not readily applicable to the diazo process. Microfilm material has a non-absorbent surface preventing condensation products from penetrating into the film, so that they are comparatively easily removable. Diazo material, on the contrary, has a paper base which absorbs a relatively large amount of developer, especially liquid phase developer.

It is also known to the prior art to use apparatus for developing photosensitive materials in a developing chamber operating with a gaseous medium, in which the developing chamber is provided with an ante-chamber at its input and output aperture for the photosensitive material, the ante-chamber containing a suction device connected to an absorber (German Utility Model No. 7,205,499). The material to be developed, or already developed, is transported between perforated guide plates arranged in the ante-chamber. The suction device comprises pipes and, if necessary, suction channels provided with bores, whose openings are not in contact with the developed material in the ante-chamber, but are separated from this material by the guide plates. In this case, the important point is to draw off the developer escaping from the output aperture, but not the developer conveyed out of the developing chamber together with the copying material.

Thus, the developer carried out with the copying material is only comparatively poorly removed before the copying material leaves the apparatus, a fact which proves disadvantageous, in particular when working with increased copying speeds, because up to 50 percent of the ammonia used in diazo printers is conveyed into the surrounding room together with the copying material.

Further, heated drying rolls are known, which sometimes have liquid-absorbent surfaces. These drying rolls, however, serve to dry a sheet material which was in direct contact with a liquid (U.S. Pat. No. 1,037,873, and German Offenlegungsschrift No. 1,905,203).

The heated rolls, which are in some cases provided with liquidabsorbent surfaces, are not suited for the diazo process, because they exert a combined thermal and mechanical stress upon the copying material, which stress may change the structure of the support of the copying material. Also, a so-called "pleating" of the copying material may occur. In both cases unusable copies will result.

The present invention is based upon the finding that diazo papers used in conventional diazo processes absorb a relatively large amount of ammonia-containing water which penetrates deeply into the paper.

It is, therefore, the object of the present invention to remove the developer, in particular the ecologically unacceptable ammonia, by simple means and as completely and carefully as possible from the developed material, i.e. not only from microfilm material with a relatively smooth surface, but especially from the normal diazo paper having an absorbent support. Further, it is desired to maintain the additional energy requirements for degassing as low as possible.

The inventive apparatus is designed in such a manner that the copying material is heated without immediately contacting a heat source and the ammonia, in particular, is drawn from the heated copying material while in direct contact with a hollow suction roller. A comparatively low suction power is thus sufficient to satisfactorily remove the developer (ammonia). Any negative effect on the copying material, such as "pleating", is avoided, since the hollow roller itself is not heated.

As the hollow roller is housed in a second chamber adjacent the output aperture of the developing chamber, it also draws up the developer gas escaping from the output aperture, as far as the roller is not covered by the copying material or by other means. However, it is the primary object of the present invention to remove the developer carried out with the copying material.

In order to ensure satisfactory degassing of the copying material, the power of the heat source is preferably chosen so as to obtain a temperature exceeding 100° C in the second chamber, i.e. in the operative section in the path of the copying material.

The shell of the hollow roller appropriately is composed of a rigid porous material, with the size of the pores not exceeding 1 millimeter. Pores of that size are sufficiently large to cause a good suction effect; at the same time, the copying material is well supported without excessive local covering of the surface thereof by the material between the pores.

In one embodiment of the invention the hollow roller rotates freely. It is driven by the copying material transported thereover and has no additional driving means.

In this case, the hollow roller must be supported to rotate with maximum ease in order to avoid any slippage between the surface of the roller and the surface of the copying material, which might damage the copying material.

In a further appropriate embodiment of the invention, the hollow roller is coupled with driving means and rotates with the same circumferential speed as the other transport means.

For drawing off the gaseous developer, the interior of the hollow roller is linked with a suction pump via an axially connected suction duct. By axially connecting the suction duct it is relatively simple to provide a seal between a stationary suction nozzle and the rotating hollow roller.

In order to remove the ammonia from the drawn off developer gas, the suction pump is linked with a container for ammonia disposal. A device for the catalytic combustion of ammonia is particularly suitable, as only a relatively small amount of interfering air is drawn in, due to the hollow roller being in direct contact with the copying material. As a result, the catalytic combustion process can be maintained with a minor supply of additional energy, if additional energy is required at all.

To minimize drawing in of interfering air, the hollow roller is advantageously shielded by a sealing plate, extending at least over that part of its circumference which is not contacted by the copying material.

The developed copying material is reliably conveyed from the output aperture to the hollow roller by guide means positioned between the aperture and the roller. Preferably, the guide means encompass at least part of the circumference of the hollow roller. The copying material is thus not only in linear contact with the roller, but contacts it on a larger part of its circumference so that the developer is more effectively drawn off over a longer section of the transport path of the copying material.

As the copying material clings to the hollow roller due to the suction effect, the roller is provided with circumferential depressions, in which depressions the fingers of a paper detaching device engage. When the copying material arrives at the point of engagement of these fingers it has been transported in contact with the roller over a section of its path. It is then detached from the roller and is conveyed to the paper discharge of the second chamber.

One embodiment of the apparatus is particularly suitable. In this case, the hollow roller is disposed close to the paper discharge of the compactly designed second chamber, so that the developed copying material must travel a relatively long distance between the output aperture of the developing chamber and the hollow roller, and heat can act on the copying material for a corresponding period of time, before the developer is drawn off. Simultaneously, the suction roller serves as a seal at the paper discharge together with a sealing roller.

In accordance with another embodiment, an infrared lamp is provided in order to transfer heat by way of radiation to the copying material. This infrared lamp yields maximum radiation at 1200° K and is well suited for the present purpose, since it converts the supplied electrical energy almost entirely into heat.

The invention will be further illustrated by reference to the accompanying drawings in which.

In the FIGS., identical parts are denoted by the same reference numerals.

Figure 1:
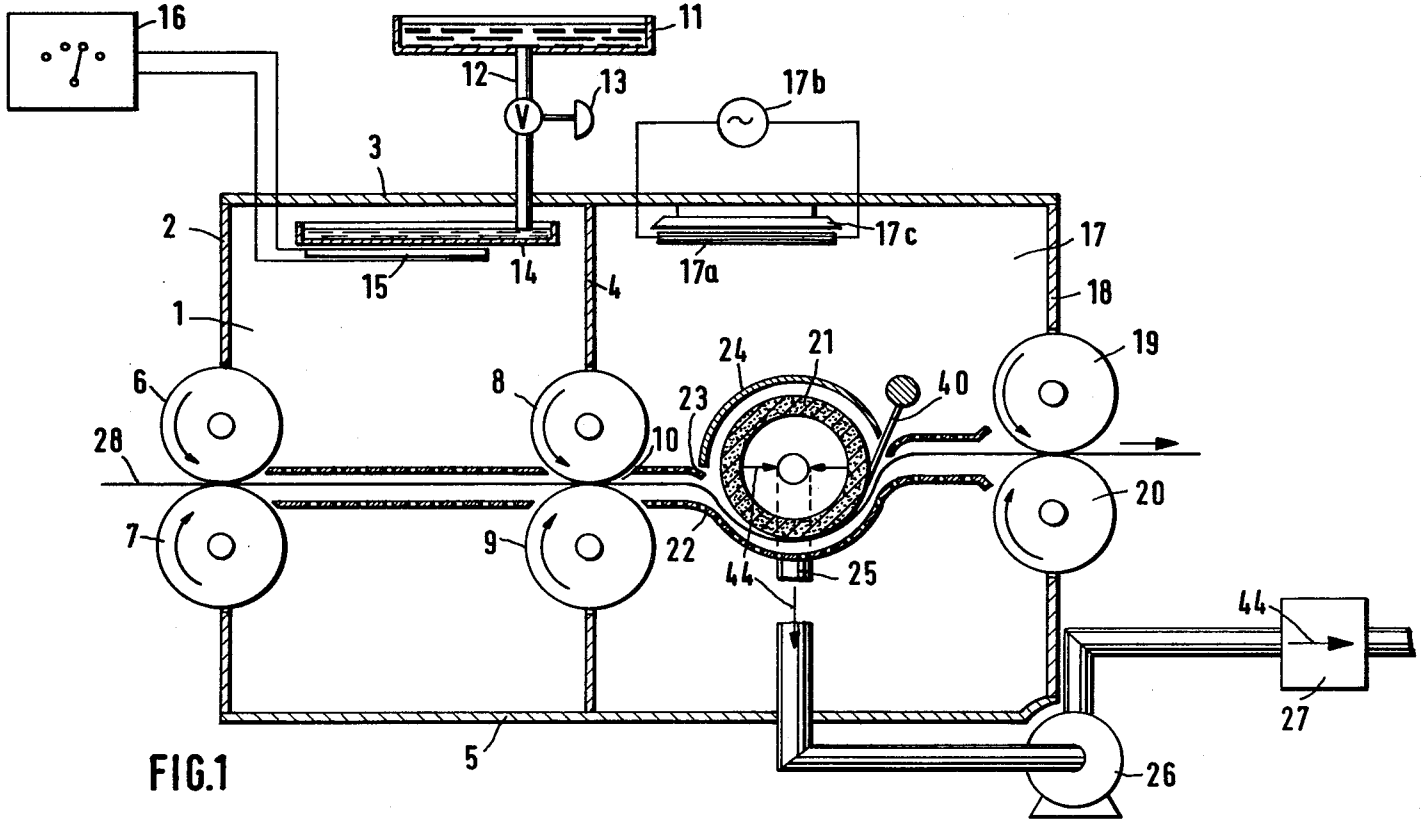
FIG. 1 is a diagrammatic longitudinal section of the apparatus.

In FIG. 1 the developing chamber is denoted 1. It is limited by the walls 2 to 5 and includes a pair of rollers 6 and 7 at the input aperture as well as a pair of rollers 8 and 9 at the output aperture. The output aperture 10 is a gap of minimum width between the rollers 8 and 9.

From a storage tank 11 for the liquid developer a duct 12 leads via a valve 13 to an evaporator 14 inside the developing chamber. The evaporator is provided with a heating element 15 connected to a temperature control device 16. If necessary, further heating elements, not shown in the drawing, may be positioned in the developing chamber to avoid condensation. The temperature thereof is adjusted in the usual manner to produce a chamber temperature below 100° C.

Adjacent the output aperture a second chamber 17 is placed behind the developng chamber. For this purpose, the walls 3 and 5 are extended to enclose the second chamber together with a wall 18 incorporating a pair of rollers 19 and 20 at the discharge end of the second chamber.

The source of heat provided in the second chamber is an infrared lamp **17*a* supplied by a source 17*b*. This infrared lamp is positioned in such a manner that at least part of the radiation thereof is directed onto the path of the copying material. In order to direct the heat, a reflector 17*c* is placed between the source of heat and the wall 3**.

Figure 2:
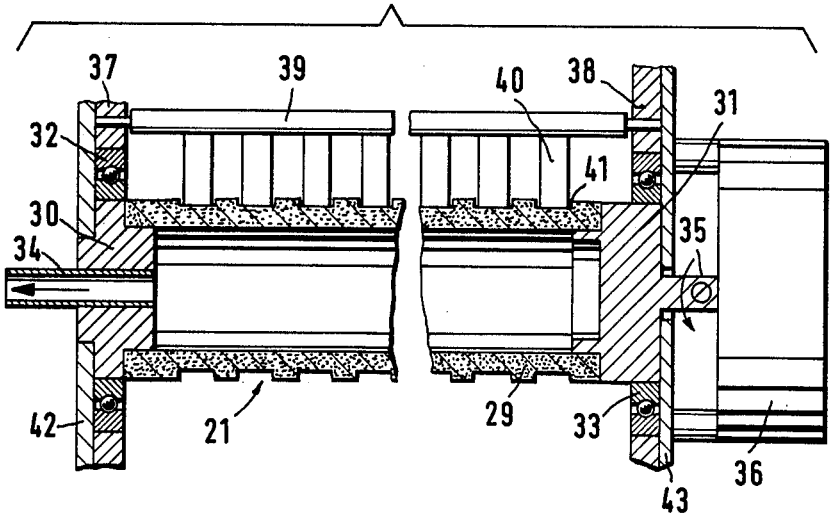
FIG. 2 shows the porous hollow roller in a sectional view parallel with the axis thereof.

Further, a porous hollow roller 21 is rotatably mounted in the second chamber. Details of the hollow roller and the support therefor are shown in FIG. 2. FIG. 1 shows perforated guiding elements 22 and 23 extending from the output aperture 10 to the pair of rollers 19 and 20 and encompassing part of the circumference of the hollow roller. The circumferential area of the hollow roller situated opposite the guiding elements 22 and 23 is shielded by a sealing plate 24 which is not in contact with the roller, but is spaced as closely as possible thereto. A suction duct 25 leads from the interior of the hollow roller to a suction pump 26 and from there to a receptacle 27 containing agents for ammonia removal. The path 28 of the copying material through the developing chamber and the second chamber is shown by the continuous line in FIG. 1.

FIG. 2 shows the shell 29 of the hollow roller composed of a sintered porous material. The roller is closed on either side by the flanges 30 and 31, which at the same time serve to support the hollow roller by means of the bearings 32 and 33. The flange 30 is penetrated by a suction nozzle 34 leading into the interior of the hollow roller, and this suction nozzle is suitable for being connected to the suction duct 25 (FIG. 1). The opposite flange 31 has a shaft end coupled with a motor 36.

FIG. 2 also shows a pivoting paper detaching device 39 mounted in the side plates 37 and 38 which serve to support the hollow roller. The fingers 40 of the paper detaching device extend into the circumferential depressions 41 provided in the shell of the roller. The side plates 37 and 38 are attached to the side walls 42 and 43 which additionally seal the interior of the second chamber. Instead of being coupled with the motor 36, the hollow roller 21 may be connected to the driving means of the rollers 6 to 9, 19 and 20 by way of gears.

During operation of the apparatus, the interior of the developing chamber 1 is filled with a vaporous ammonia/water mixture. As required, aqueous developer solution is added to this mixture from the storage tank. The temperature for evaporation is adjusted by means of the temperature control device 16. Copying material is pulled into the developing chamber by the pair of rollers 6 and 7 and is then conveyed towards the pair of rollers 8 and 9 at the output aperture, where it leaves the developing chamber.

In the second chamber, the copying material is transported by the guiding elements 22 and 23, and while being heated by the heat source 17*a* it approaches the hollow roller 21. It then moves along with the rotating hollow roller until it reaches the fingers of the paper detaching device 39. The developer released by heating the copying material is drawn off in the direction of the arrows 44 shown in FIG. 1. While a major part of the suction power acts on the surface of the copying material, part of it is available for drawing off the gas mixture entrapped in the second chamber 17. This gas mixture contains developer gas which has escaped from the output aperture 10. The percentage of suction power available for drawing off the developer directly from the copying material, relative to the remaining suction power drawing the gas mixture from the second chamber is determined by the size and the position of the sealing plate 24.

The drawn off gas is conveyed to the receptacle 27 via the suction duct 25 and the pump 26, and in the receptacle the undesirable and, in higher concentrations, even harmful ammonia contained in the waste air is destroyed.

Figure 3:
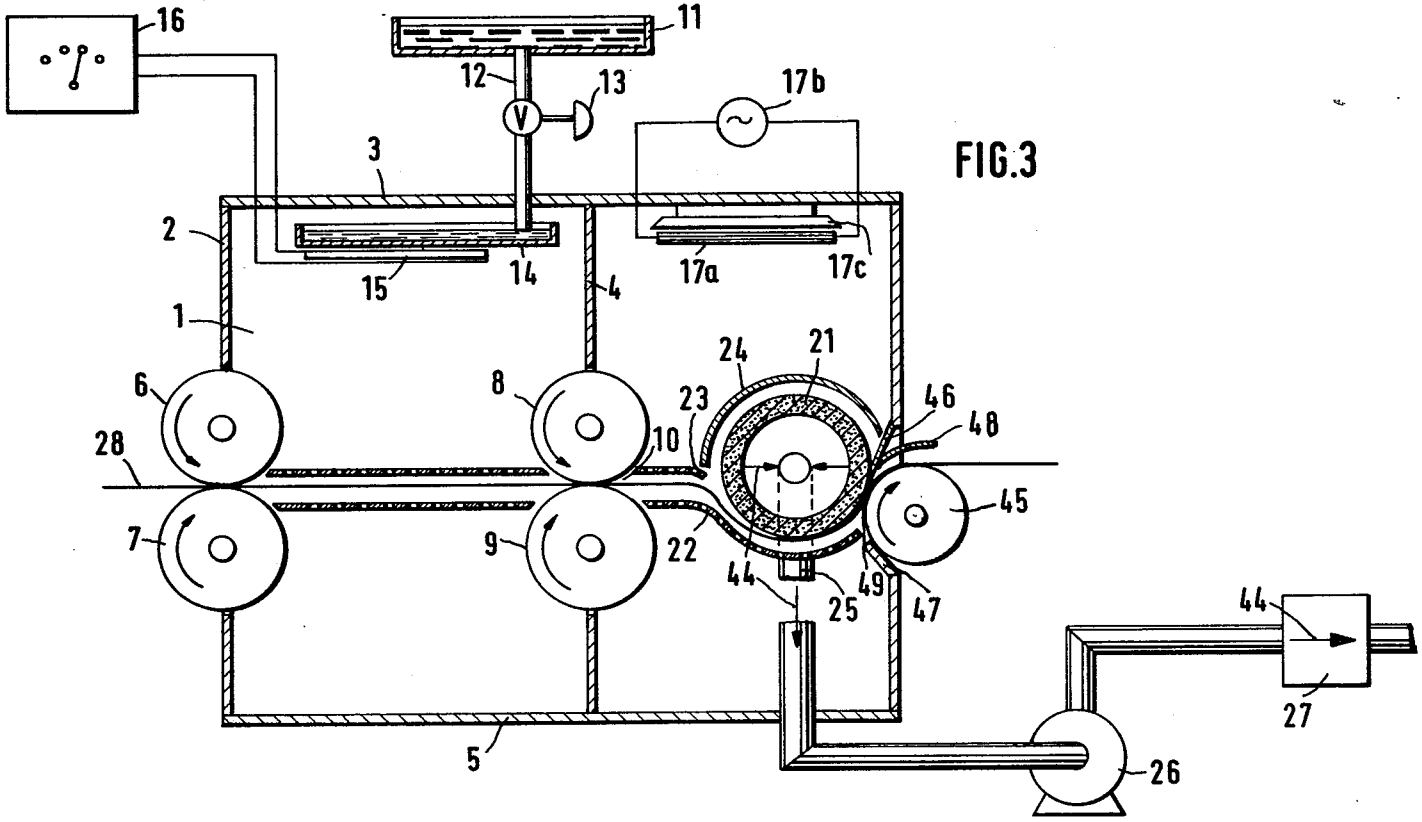
FIG. 3 is an alternative embodiment of the apparatus according to FIG. 1, also represented in a longitudinal section.

In the embodiment according to FIG. 3 the suction roller 21 is arranged close to the discharge opening 49 of the second chamber 17. By this arrangement, the developed copying material leaving the developing chamber is heated while covering practically the same distance as in the embodiment shown in FIG. 1, although the second chamber shown in FIG. 3 is considerably shorter. In addition, the suction roller in FIG. 3 serves to seal the second chamber together with the sealing roller 45 which is in contact therewith. A special pair of rollers is, therefore, not required for that purpose. For further sealing the discharge opening an upper lamella 46 contacts the suction roller and, similarly, a lower lamella 47 is provided at the sealing roller 45. The upper lamella 46 also serves to detach the copying material and the sealing roller 45 has the additional function of guiding the copying material which is deviated by a guide plate 48 positioned above the discharge opening.

It will be obvious to those skilled in the art that many modifications may be made within the scope of the present invention without departing from the spirit thereof, and the invention includes all such modifications.

What is claimed is:

1. In a diazo copier comprising a first developing chamber for developing a diazo material employing an ammonia-containing vaporous developer, a second chamber adjacent an output aperture of the first developing chamber, a source of heat and a suction device for drawing off developer escaping from the second developing chamber through an output aperture and for removing developer from the diazo material, the improvement comprising a rotatably mounted porous hollow roller means forming part of said suction device positioned in said second chamber, suction duct means connected to said roller means, and there being no heat-conducting means between the source of heat and transport means provided for bringing the copying material in contact with the hollow suction roller means.

2. A diazo copier according to claim 1 in which the source of heat in the second chamber is of sufficient power to ensure a temperature exceeding 100° C in the second chamber.

3. A diazo copier according to claim 1 in which the hollow roller means comprises a shell means composed of a rigid porous material with pores not exceeding 1 millimeter in size.

4. A diazo copier according to claim 1 including an axially connected suction duct connected to the interior of the hollow roller means and to a suction pump.

5. A diazo copier according to claim 4 including catalytic combustion means connected downstream of the suction pump.

6. A diazo copier according to claim 1 including sealing plate means over at least part of the circumference of the hollow roller means.

7. A diazo copier according to claim 1 including guiding element means for developed copying material arranged between the output aperture of the first developing chamber and the hollow roller means.

8. A diazo copier according to claim 7 in which the guiding element means encompass at least part of the circumference of the hollow roller means.

9. A diazo copier according to claim 1 including circumferential depression means in said hollow roller means which are adapted to be engaged by fingers of a paper detaching means.

10. A diazo copier according to claim 7 in which the guiding element means extend from the output aperture of the first developing chamber over part of the circumference of the hollow roller means up to a discharge opening of the second chamber.

11. A diazo copier according to claim 1 in which the hollow roller means is positioned inside the second chamber close to a discharge opening in the second chamber and including sealing roller means also positioned at said discharge opening in contact with the hollow roller means.

12. A diazo copier according to claim 11 including a lamella contacting the hollow roller means and a lamella contacting the sealing roller at the discharge opening in order to additionally seal the second chamber.

13. A diazo copier according to claim 1 in which the source of heat in the second chamber is a heat radiator.

14. A diazo copier according to claim 13 in which the heat radiator is an infrared lamp.

* * * * *